US005258354A

United States Patent [19]

Tack

[11] Patent Number: 5,258,354

[45] Date of Patent: Nov. 2, 1993

[54] PROCESSES FOR INCREASING THE DENSITY OF IMAGES OBTAINED BY THERMAL SUBLIMATION TRANSFER AND PRINTER FOR PERFORMING THESE PROCESSES

[75] Inventor: Henri M. Tack, Edegem, Belgium

[73] Assignee: Agfa-Gevaert, N.V., Mortsel, Belgium

[21] Appl. No.: 732,763

[22] Filed: Jul. 19, 1991

[30] Foreign Application Priority Data

Jul. 27, 1990 [EP] European Pat. Off. ..... 90202057.7

[51] Int. Cl.[5] ..... B41M 5/035; B41M 5/38

[52] U.S. Cl. ..... 503/227; 427/258; 427/261; 427/265; 428/195; 428/913; 428/914

[58] Field of Search ..... 8/471; 428/195, 212, 428/913, 914; 503/227; 427/258, 261, 265

[56] References Cited

U.S. PATENT DOCUMENTS 4,833,124 5/1989 Lum ..... 503/227

4,933,686 6/1990 Izumi et al. ..... 346/1.1

*Primary Examiner*—B. Hamilton Hess

*Attorney, Agent, or Firm*—Breiner & Breiner

[57] ABSTRACT

Processes for increasing the density of images obtained by thermal dye sublimation transfer and printer for performing these processes.

In addition to a dye transfer step, the same portion of a dye donor element is at least one more time image-wise heated and a second dye image which is in register with said first dye image is transferred to said receiving element.

Alternatively, to a dye transfer step at least one step is added in which another portion of the dye donor element is image-wise heated and the image is transferred not in register with the image transferred during the first step.

7 Claims, No Drawings

PROCESSES FOR INCREASING THE DENSITY OF IMAGES OBTAINED BY THERMAL SUBLIMATION TRANSFER AND PRINTER FOR PERFORMING THESE PROCESSES

FIELD OF THE INVENTION

The present invention is in the field of thermal printing and more specifically relates to a process for increasing the density of images obtained by a thermal dye sublimation transfer process and to an apparatus for carrying out this process.

DESCRIPTION OF THE STATE OF THE ART

Thermal dye sublimation transfer is a recording method in which a dye donor element provided with a dye layer containing sublimable dyes having heat transferability is brought into contact with a receiver sheet and heated selectively in accordance with a pattern information signal by means of a thermal printing head.

Dye is transferred from the selectively heated regions of the dye donor element to the receiver sheet forming a dye pattern thereon. The shape and density of this pattern is in accordance with the pattern and intensity of heat applied to the dye-donor element Image-wise heating can be obtained by means of a thermal printing head comprising a plurality of juxtaposed resistors, alternatively image-wise heating can be obtained by application of laser light to the dye sublimation transfer element.

Still alternatively, resistive ribbon printing may be used. According to this technology highly localized heating of a conductive thermal sublimation transfer ribbon is obtained by injection of current into the ribbon.

The pattern information signal can be in the form of electronic representations of colour separation images obtained by subjecting a colour picture to be printed to color separation through color filters. The electronic representations of the colour separation images are transformed into signals corresponding to yellow, magenta, cyan and possibly black separations and are then applied to the thermal head of the thermal dye sublimation transfer printer.

In the printer a yellow, magenta, cyan and possibly black dye donor element is placed face-to-face to a receiving element. The donor and the receiving element are then inserted between a thermal printing head and backing means e.g. a roller. For example a line-type thermal head can be used to apply heat to the dye donor element. The signal corresponding with one of the primary color separation images (yellow, magenta, cyan and Possibly black) is applied to the thermal head and a corresponding picture is obtained by applying the heat of the thermal head to a part of the dye donor element of the same color. The process is repeated for the other primary color images in register.

In case the density obtained by the above process would be insufficient, improved results can be obtained by acting upon the composition of the dye donor element or the receiving element or by adapting the printing process itself.

In U.S. Pat. No. 4,833,124 a density improving process applied to thermal dye sublimation transfer printing has been described.

According to this process, in addition to a first dye image transfer step (in which a portion of a dye donor element is heated) at least one further dye image transfer step follows wherein another unused portion of the dye donor element or another dye donor element is heated and a second dye image is transferred, which second transferred image is of the same hue as the first dye image and is in register with said first dye image.

Processes of the above kind have the following major disadvantages: they are slow since at least two printing cycles are required and are highly consuming dye donor element.

OBJECTS OF THE INVENTION

It is an object of the present invention to provide a process for increasing the density of images obtained by a thermal dye transfer process that does not show the drawbacks of the prior art methods.

It is a further object of the present invention to provide a thermal dye sublimation transfer printer by means of which the method of the present invention can be carried out.

Still further objects will become apparent from the description hereinbelow.

STATEMENT OF THE INVENTION

To overcome the above mentioned deficiencies the present invention provides a thermal d e sublimation transfer process comprising image-wise heating a dye donor element comprising a support having thereon a dye layer and transferring a dye image to a dye-receiving element characterized in that after a first image-wise transfer of dye from a portion of said dye donor element has occurred, the same portion of said dye donor element is identically image-wise heated at least one more time to transfer to said receiving element (a) further dye image(s) in register with said first dye image.

In a preferred embodiment, said image-wise heating is performed on a line-byline basis. The transfer of the dye image of a certain line is followed at least one more time by the transfer of the dye image of the same line information through the same portion of the dye donor element in register with said first transferred line.

The invention further discloses a process of the above kind modified in that after a first image-wise transfer of dye from a portion of said dye donor element has occurred, at least one more time another portion of the dye donor element or another dye donor element of the same hue is identically image-wise heated so as to transfer (a) further dye image(s) of the same hue to said receiving element in an at least partially overlapping position relative to said first transferred image.

In a preferred modified embodiment, said image-wise heating is performed on a line-by-line basis. The transfer of the dye image of a certain line is followed at least once by the transfer of the dye image of the same line information through another portion of the dye donor element or through another dye donor element of the same hue. The corresponding dye image is transferred to said receiving element in an at least partially overlapping condition relative to said first transferred line. The overlap is in the direction of relative displacement of the dye donor element, the dye-receiving element and the heating means during recording.

Alternatively the overlap can be obtained by applying a driving signal corresponding with the same image information to more than one array of heating elements provided at a fixed relative distance.

The image-wise heating in the above-described processes can be obtained by means of a thermal print head comprising individually energisable elements as hereinbefore described. Alternatively, image-wise heating can be obtained by application of laser light to the dye donor element.

Alternatively resistive ribbon printing may be used. According to this technique current is injected into a conductive thermal sublimation transfer ribbon thereby producing highly localized heating of the ribbon and sublimation of the dye provided on the ribbon.

The processes are hereinbefore described in respect of one color. However, to obtain a multicoloured image partial images corresponding to color separations of the image to be reproduced are printed in register. For example a dye donor transfer element is used comprising sequential repeating areas of yellow, magenta, cyan and possibly black dye and the process(es) of the present invention is(are) applied for each of these colors.

The above-described process may also be used in case of black-and-white printing.

The invention further relates to a thermal sublimation transfer printer comprising means for supplying a dye donor element comprising a support having a dye layer thereon, means for supporting a receiving element adjacent to said dye donor element, means for image-wise heating said dye donor element and transferring a dye image to said dye-receiving element, and means for driving said supplying and said supporting means, characterized in that means are provided for controlling the relative displacement of the dye receiving element, the dye donor element and the heating means over a distance equal to one line width after the same image or part thereof has been transferred at least two times through application of heat to the same portion of said dye donor element.

Further the invention relates to an apparatus of the above kind modified in that the control means provides that after a first image-wise transfer of dye from a portion of said dye donor element has occurred, the dye receiving element, the dye donor element and the heating means are relatively displaced over a distance smaller than one line width and that the same image or part thereof is at least one further time transferred by identically image-wise heating another portion of said dye donor element or another dye donor element of the same hue.

In a preferred embodiment image-wise heating and transfer is performed on a line-by-line basis, i.e. the heating means form a 1 dimensional array.

In case a dye donor transfer element is used comprising sequentially repeating areas of yellow, magenta, cyan and possibly black dye, the control means of the apparatus of the present invention may operate as hereinbefore described on each of these colors and the related primary color separation in sequence or only on some of them. More specifically, the dye image corresponding with the first primary color separation is transferred by operation of the control means of the apparatus of the present invention, before a second color separation image is transferred in register.

The means for image-wise heating a dye donor element may comprise a thermal head comprising individually energisable heating elements. Other embodiments such as a laser or resistive ribbon technology may be envisioned.

In colour dye sublimation transfer, commonly a ribbon having repeated sequences of yellow, magenta, cyan and/or black strokes is used. When the process is performed by using more than one stroke of the same hue, it is necessary to be able to retrieve on a dye donor element a stroke of said hue.

For this purpose the dye donor element is commonly provided with detection marks. For example marks can be used that are optically detectable by a photosensor when they are irradiated with a light source.

The marks can be formed by a light absorbing or light reflecting coating in a preassigned position on the donor element. They can comprise an infrared shielding compound such as carbon black or they can comprise one of the dyes that are used for image formation.

For example, four different colors can be identified by means of a combination of three identical cyan markers that are provided at the side of each of the distinct color blocks on a four-color thermal sublimation ribbon.

By means of detection means in the printer (illuminating sources and detectors having a suitable spectral sensitivity) and by means of suitable decoding means the color of that part of the ribbon that will be shifted under the thermal head of the printer can be determined.

Commonly different kinds of receiving materials, for example paper or transparencies can be used in a thermal sublimation transfer printer. When the option of printing on different kinds of receiving materials is available, the operator commonly informs the printer about the selected kind of receiving material via the user interface of the printer. Preferably the printer is then provided with a system for detecting the material that is fed into the printer and for generating a signal indicative hereof so that in dependence on the result of a comparison of this detection and the selection made by the operator a printing cycle is started or an error indication is given or the printing material is rejected.

Automatic detection of the receiving material that is fed into the apparatus can be performed in different ways. For example, when receiving material is fed into the printer out of a cassette, the provision of a notch in the cassette can give an indication of which cassette is mounted in the printer and of the kind of material that will be supplied. Alternatively reflection or transmission of light by the supplied material can be detected for example after paper or transparency pick-up by the printer and can be used to give an indication on the kind of receiving material.

EMBODIMENTS

The following is a description of a thermal dye sublimation transfer printer by means of which comparative test were performed in order to enable evaluation of the densities obtained by different thermal sublimation transfer processes.

A receiving sheet was fastened on a rubber roller that was driven by a stepper motor. A color dye donor element provided in the form of a cassette was placed in between the rubber roller and a Kyocera KST-80-6MPD1 thermal head. The thermal head and the roller were pressed against each other at a force of 1.5 kg.

The speed at which the color dye donor element was advanced in between the thermal head and the rubber roller was equal to the speed of the rubber roller itself.

Control of the relative movement of the dye donor element and the dye receiving element relative to the thermal head was performed by controlling the speed of the rubber roller.

A voltage of approximately 26 V was applied to the resistive elements of the thermal head.

THE FOLLOWING TESTS WERE CARRIED OUT

TEST 1

A test image was generated on a receiving element using the individual yellow, magenta, cyan and possibly black part of the dye donor element by activating the elements of the printing head during 8 msec and then cooling the head during 13 msec.

The rubber roller carrying the receiving element is displaced over a distance equal to the line width after each line cycle.

TEST 2

A test image was generated by means of the identical setting of the thermal head as described with reference to method 1, however, the rubber roller onto which the receiving element was fastened and that was driven by means of a stepper motor was moved for one half of the line width after each line cycle. The dye donor element was displaced after each transfer cycle.

TEST 3

A test image was generated on a receiving element using the individual yellow, magenta, cyan and possibly black part of the dye donor element by activating the elements of the printing head during 8 msec and cooling the head during 13 msec. The same printing cycle is performed once more without displacing the dye donor element nor the dye receiving element, the image (or image line) is hence transferred a second time in register with the first transferred image.

Prints corresponding with an 8 step density wedge were generated by means of the three above-described methods.

In a first test a combination named A comprising a Mitsubishi CK100TS paper receiving element and the corresponding dye donor ribbon was used. In a second test a combination B comprising Mitsubishi's CK100TS transparencies and the corresponding dye donor ribbon was used.

The prints obtained by the above-described three methods were analyzed by means of a Macbeth TR924 status A densitometer. Combination A was measured in reflection, combination B was measured in transmission.

The densities obtained by means of methods 2 and 3 are increased compared to the results obtained by means of method 1.

| Single color transfer/Combination A | | |
|---|---|---|
| method 1 | method 2 | method 3 |
| | Yellow | |
| 0.10 | 0.11 | 0.11 |
| 0.17 | 0.33 | 0.32 |
| 0.43 | 0.72 | 0.71 |
| 0.70 | 1.15 | 1.14 |
| 0.87 | 1.46 | 1.48 |
| 1.22 | 1.96 | 1.94 |
| 1.68 | 2.32 | 2.32 |
| 1.83 | 2.38 | 2.38 |
| | Magenta | |
| 0.08 | 0.09 | 0.09 |
| 0.13 | 0.26 | 0.26 |
| 0.39 | 0.66 | 0.68 |

-continued

| Single color transfer/Combination A | | |
|---|---|---|
| method 1 | method 2 | method 3 |
| 0.66 | 1.09 | 1.13 |
| 0.84 | 1.42 | 1.46 |
| 1.18 | 1.82 | 1.87 |
| 1.62 | 2.18 | 2.24 |
| 1.80 | 2.23 | 2.31 |
| | Cyan | |
| 0.06 | 0.06 | 0.06 |
| 0.12 | 0.25 | 0.25 |
| 0.38 | 0.67 | 0.67 |
| 0.76 | 1.14 | 1.16 |
| 0.94 | 1.51 | 1.57 |
| 1.30 | 2.06 | 2.13 |
| 1.88 | 2.58 | 2.55 |
| 2.04 | 2.62 | 2.70 |

| Single color transfer/Combination B | | |
|---|---|---|
| Method 1 | method 2 | method 3 |
| | Yellow | |
| 0.00 | 0.00 | 0.00 |
| 0.01 | 0.04 | 0.04 |
| 0.06 | 0.18 | 0.14 |
| 0.15 | 0.39 | 0.37 |
| 0.25 | 0.61 | 0.55 |
| 0.41 | 0.93 | 0.88 |
| 0.72 | 1.33 | 1.23 |
| 0.80 | 1.39 | 1.32 |
| | Magenta | |
| 0.00 | 0.00 | 0.00 |
| 0.01 | 0.05 | 0.04 |
| 0.07 | 0.21 | 0.17 |
| 0.17 | 0.46 | 0.40 |
| 0.29 | 0.73 | 0.64 |
| 0.50 | 1.17 | 1.05 |
| 0.83 | 1.65 | 1.54 |
| 0.95 | 1.79 | 1.65 |
| | Cyan | |
| 0.00 | 0.01 | 0.00 |
| 0.03 | 0.08 | 0.07 |
| 0.11 | 0.28 | 0.24 |
| 0.24 | 0.54 | 0.49 |
| 0.37 | 0.80 | 0.74 |
| 0.56 | 1.19 | 1.12 |
| 0.89 | 1.59 | 1.47 |
| 1.00 | 1.74 | 1.65 |

I claim:

1. A process for increasing the density of a thermal dye sublimation transfer image comprising image-wise heating a dye donor element comprising a support having thereon a dye layer and transferring a dye image to a dye-receiving element characterized in that after a first image-wise transfer of dye from a portion of said dye donor element has occurred, the same portion of said dye donor element is identically image-wise heated at least one more time to transfer to said receiving element (a) further dye image(s) in register which said first dye image and that successive transfers are separated in time so as to provide intermediate cooling.

2. A process according to claim 1 wherein said image-wise heating is performed on a line-by-line basis and the transfer of the dye image corresponding with a line is followed at least one time by the line-wise heating of the same portion of said dye donor element and by the transfer of a second dye image of said line in register with said first transferred image.

3. A process according to claim 1 wherein said dye donor element comprises sequentially repeating areas of at least yellow, magneta and cyan dye and wherein said process steps are performed for each color.

4. A process according to claim 1 whereby said dye donor element comprises sequentially repeating areas of yellow, magenta, cyan and black dye.

5. A process according to claim 1 wherein image-wise heating of said dye donor element is obtained by means of a thermal print head comprising individually energizable heating elements.

6. A process according to claim 1 wherein said image-wise heating is performed by means of a laser.

7. A process according to claim 1 wherein said image-wise heating is obtained by injection of current into a conductive dye donor element.

* * * * *